US005920034A

United States Patent [19]

Saka et al.

[11] Patent Number: 5,920,034

[45] **Date of Patent: *Jul. 6, 1999**

[54] ELECTRICAL CONNECTION BOX

[75] Inventors: Yuuji Saka; Nori Inoue; Takahiro Onizuka; Yoshito Oka; Makoto Kobayashi, all of Yokkaichi, Japan

[73] Assignee: Sumitomo Wiring Systems, Ltd., Yokkaichi, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/578,957

[22] Filed: Dec. 27, 1995

[30] Foreign Application Priority Data

Dec. 28, 1994 [JP] Japan ..... 6-326980

[51] Int. Cl.[6] ..... H01R 13/46

[52] U.S. Cl. ..... 174/59; 439/76.2

[58] Field of Search ..... 174/52.1, 52.4, 174/72 B, 70 B, 99 B, 59; 439/76.2, 402, 621, 622, 43, 44; 361/775, 826

[56] References Cited

U.S. PATENT DOCUMENTS

| | | | |
|---|---|---|---|
| 5,057,026 | 10/1991 | Sawai et al. | 439/76 |
| 5,207,587 | 5/1993 | Hamill et al. | 439/76.2 |
| 5,295,842 | 3/1994 | Ozaki et al. | 439/76 |
| 5,327,643 | 7/1994 | Sakamoto et al. | 29/830 |
| 5,412,861 | 5/1995 | Fudoo et al. | 29/564.2 |
| 5,501,605 | 3/1996 | Ozaki et al. | 439/34 |
| 5,653,607 | 8/1997 | Saka et al. | 439/402 |
| 5,718,598 | 2/1998 | Saka et al. | 439/404 |
| 5,759,050 | 6/1998 | Matsuoka et al. | 439/76.2 |

FOREIGN PATENT DOCUMENTS

| | | |
|---|---|---|
| 0388058 | 9/1990 | European Pat. Off. . |
| 1166419 | 11/1989 | Japan . |
| 2136989 | 11/1990 | Japan . |
| 05300627 | 11/1993 | Japan . |
| 06038338 | 2/1994 | Japan . |
| 06197432 | 7/1994 | Japan . |

OTHER PUBLICATIONS

European Search Report issued Jun. 11, 1997.

*Primary Examiner*—Kristine Kincaid
*Assistant Examiner*—Hung V Ngo
*Attorney, Agent, or Firm*—Greenblum & Bernstein P.L.C.

[57] ABSTRACT

An upper casing and a lower casing together form a casing of an electrical connection box. An insulating plate is provided within the casing. A first space is thereby defined within the casing between the insulating plate and the one of the upper and lower casings, and a second space defined within the casing between the insulating plate and the remaining one of the upper and lower casings. A first circuit, formed by bus bars, is disposed in the first space. A second circuit is formed by wires and pressing contact terminals in pressing contact with the wires. Wires of a portion of the second circuit are shifted to the first space, and wires of the remaining portion of the second circuit are disposed within the second space.

7 Claims, 5 Drawing Sheets

ELECTRICAL CONNECTION BOX

BACKGROUND OF THE INVENTION

The present invention generally relates to electrical connection boxes and more particularly, to an electrical connection box in which a circuit formed by bus bars and a circuit formed by wires and pressing contact terminals connected to the wires can be installed reasonably.

In an electrical connection box used for connecting wiring harnesses or the like for a motor vehicle to various electric devices through branching, a branching connection point is concentrated at one spot such that branching connection of wires is performed reasonably and economically. In response to recent trends towards higher density of wiring harnesses, various types of electrical connection boxes have been developed for different models of motor vehicles and for different applications.

FIG. 1 shows one example of such known electrical connection boxes. The known electrical connection box includes an upper casing 1, a lower casing 2 and an insulating plate 3 provided in the upper and lower casings 1 and 2. A circuit formed by flat bus bars 4 is disposed on one face 3*a* of the insulating plate 3 adjacent to the upper casing 1, while a circuit formed by a number of single-conductor wires 5 is disposed in a space S defined between the other face 3*b* of the insulating plate 3 adjacent to the lower casing 3 and an inner face of the lower casing 2.

The circuit formed by the flat bus bars 4 and the circuit formed by the single-conductor wires 5 are employed as an internal circuit of the electrical connection box for the following reason. Namely, a load circuit which is subjected to design changes relatively frequently is constituted by the single-conductor wires 5 and pressing contact terminals (not shown) such that it becomes possible to easily cope with design changes of the load circuit.

However, usually, the circuit formed by the flat bus bars 4 and the circuit formed by the single-conductor wires 5 occupy 20% and 80% of the internal circuit of the electrical connection box, respectively. Therefore, since the circuit formed by the single-conductor wires 5 is far more than the circuit formed by the flat bus bars 4, the circuit formed by the single-conductor wires 5 is concentrated in the space S extraordinarily. As a result, such problems arise that productivity of the known electrical connection box deteriorates due to complication of laying of the single-conductor wires 5 and the known electrical connection box becomes larger in size owing to increase of its height H.

SUMMARY OF THE INVENTION

Accordingly, an essential object of the present invention to provide, with a view to eliminating the above mentioned drawbacks of conventional electrical connection boxes, an electrical connection box having an internal construction which mitigates extraordinary concentration of a circuit formed by single-conductor wires so as to not only improve productivity of the electrical connection box through simplification of laying of the single-conductor wires but make the electrical connection box more compact in size.

In order to accomplish this object of the present invention, an electrical connection box according to the present invention comprises: an upper casing; a lower casing which forms a casing of the electrical connection box together with the upper casing; an insulating plate which is provided in the casing; wherein a first space is defined between the insulating plate and one of the upper and lower casings, while a second space is defined between the insulating plate and the other of the upper and lower casings; a first circuit which is formed by bus bars and is disposed in the first space; and a second circuit which is formed by wires and pressing contact terminals brought into pressing contact with the wires; wherein a portion of the second circuit is shifted to the first space, while the remaining portion of the second circuit is disposed in the second space.

Each of the wires is a wire having a single conductor, while each of the bus bars is a flat bus bar.

Meanwhile, the wires of the portion of the second circuit are disposed on or beneath the bus bars.

In case the wires of the portion of the second circuit are disposed beneath the bus bars, it is preferable that the wires of the portion of the second circuit are inserted into wiring grooves formed on the insulating plate.

Furthermore, a portion of each of the pressing contact terminals brought into pressing contact with conductors of the wires of the portion of the second circuit can be brought into contact with each of the bus bars so as to be electrically connected to each of the bus bars.

In accordance with the present invention, in order to prevent the second circuit formed by the wires and the pressing contact terminals from being extraordinarily concentrated in the second space, a portion, for example, about 30% of the second circuit is shifted to the first space in which the first circuit formed by the bus bars is disposed, so that the second circuit can be disposed in good proportion in the first and second spaces confronting opposite faces of the insulating plate, respectively.

As a result, since wiring in the electrical connection box can be performed easily, productivity of the electrical connection box is raised. Furthermore, since dead space in the first space in which the first circuit formed by the bus bars is disposed can be effectively used for receiving the portion of the second circuit, the casing of the electrical connection box can be reduced and thus, the casing of the electrical connection box can be made compact in size.

If the wires each having a single conductor are brought into pressing contact with the pressing contact terminals, contact area between the wires and the pressing contact terminals can be kept constant and thus, the wires can be electrically connected to the pressing contact terminals stably. Meanwhile, if flat bus bars are employed as the bus bars, height of the bus bars and the wires can be restricted even if the wires are disposed on or beneath the bus bars.

The portion of the second circuit is shifted to the first space and the wires of the portion of the second circuit may be disposed, as required, on or beneath the bus bars by inserting the wires of the portion of the second circuit into the grooves formed on the insulating plate.

Furthermore, if the pressing contact terminals are brought into contact with the bus bars in the portion of the second circuit, inner sides of a pressing contact blade of each of the pressing contact terminals, for example, are brought into contact with a conductor of each of the single-conductor wires and outer sides of the pressing contact blade are brought into contact with inner faces of each of slots formed on the bus bars such that the first circuit formed by the bus bars and the second circuit formed by the wires and the pressing contact terminals can be directly connected to each other. Consequently, design changes of the internal circuit of the electrical connection box can be performed easily.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 2:
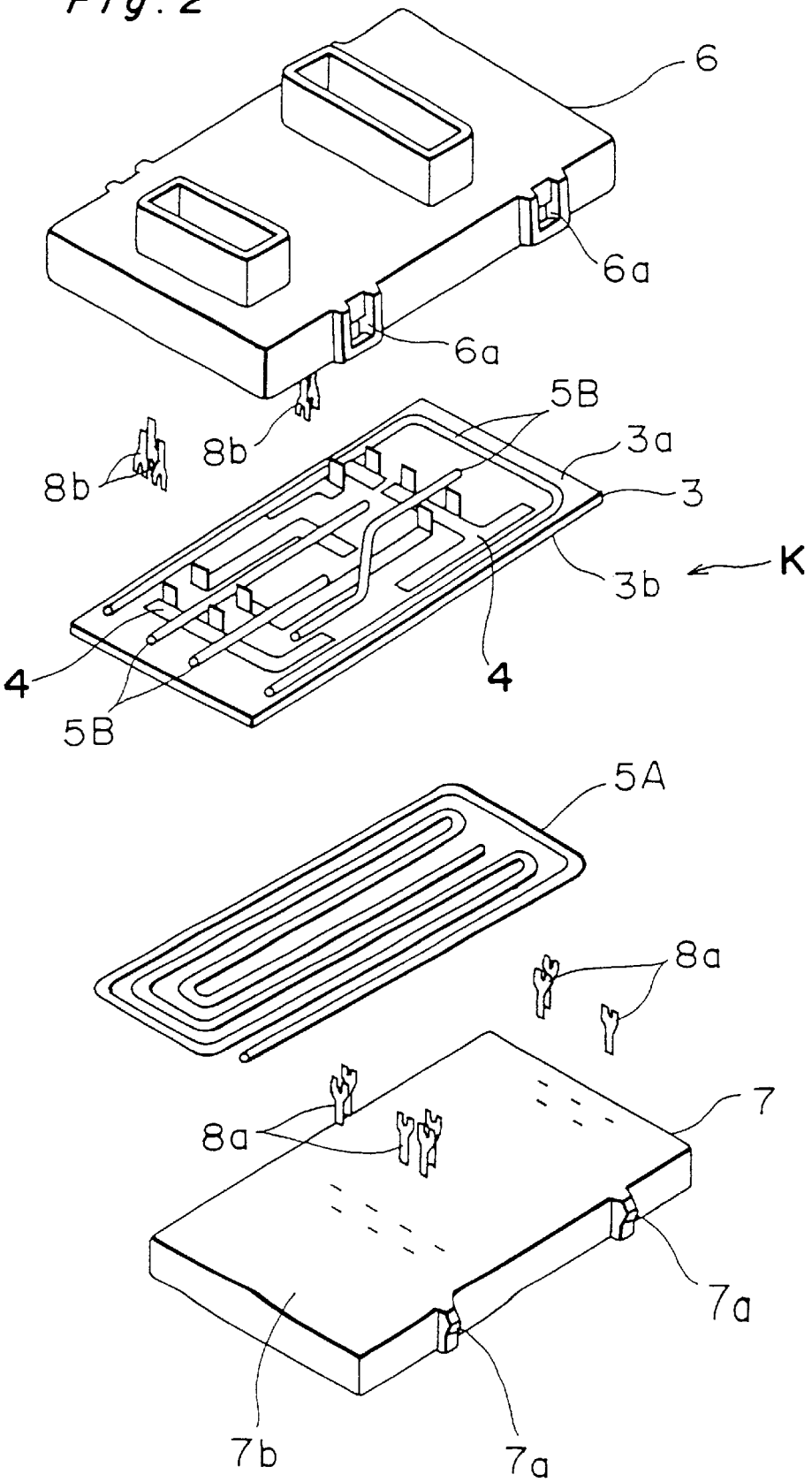
FIG. 2 is an exploded perspective view of an electrical connection box according to one embodiment of the present invention.
Figure 9:
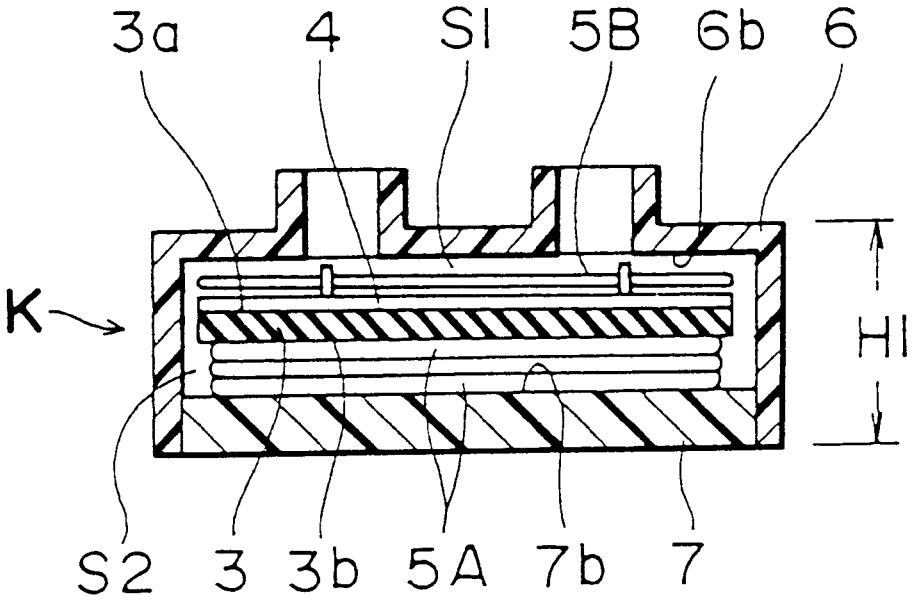
FIG. 9 is a sectional view of the electrical connection box of FIG. 2.

Referring now to the drawings, there is shown in FIGS. 2 and 9, an electrical connection box K according to one embodiment of the present invention. The electrical connection box K includes an upper casing 6 and a lower casing 7. The upper casing 6 is put on the lower casing 7 from above so as to bring locking claws 7*a* of the lower casing 7 into engagement with locking openings 6*a* of the upper casing 6 such that the upper and lower casings 6 and 7 are locked to each other. Thus, a casing of the electrical connection box K is formed by the upper casing 6 and the lower casing 7.

An insulating plate 3 is horizontally provided in the upper and lower casings 6 and 7. Thus, a space S1 is defined between an upper face 3*a* of the insulating plate 3 and an inner face 6*b* of the upper casing 6, while a space S2 is defined between a lower face 3*b* of the insulating plate 3 and an inner face 7*b* of the lower casing 7. A circuit formed by flat bus bars 4 is placed on the upper face 3*a* of the insulating plate 3, while a circuit formed by a number of single-conductor wires 5A is disposed in the space S2 between the lower face 3*b* of the insulating plate 3 and the inner face 7*b* of the lower casing 7.

Conventionally, the circuit formed by the single-conductor wires 5A is disposed in the space S2 and occupies about 80% of an internal circuit of the electrical connection box, while about 20% of the internal circuit is occupied by the circuit formed by the flat bus bars 4.

In the same manner as prior art, the circuit formed by the flat bus bars 4 occupies about 20% of an internal circuit of the electrical connection box K. On the other hand, in contrast with prior art, the internal circuit of the electrical connection box K further includes a circuit formed by single-conductor wires 5B. Thus, the circuit formed by the single-conductor wires 5A and the circuit formed by the single-conductor wires 5B occupy about 80% of the internal circuit of the electrical connection box K and have a ratio of about 7 to 3. Namely, the circuit formed by the single-conductor wires 5A and the circuit formed by the single-conductor wires 5B occupy about 56% and 24% of the internal circuit of the electrical connection box K, respectively. The circuit formed by the single-conductor wires 5B is disposed in the space S1 between the upper face 3*a* of the insulating plate 3 and the inner face 6*b* of the upper casing 6.

A pressing contact blade of each of a plurality of pressing contact terminals 8*a* is thrust into an insulating coating of each of the single-conductor wires 5A so as to bring an inner side of the pressing contact blade into contact with a conductor of each of the single-conductor wires 5A such that the pressing contact terminals 8*a* are electrically connected to the single-conductor wires 5A. Similarly, a pressing contact blade of each of a plurality of pressing contact terminals 8*b* is thrust into an insulating coating of each of the single-conductor wires 5B so as to bring an inner side of the pressing contact blade into contact with a conductor of each of the single-conductor wires 5B such that the pressing contact blades 8*b* are electrically connected to the single-conductor wires 5B.

Figure 1:
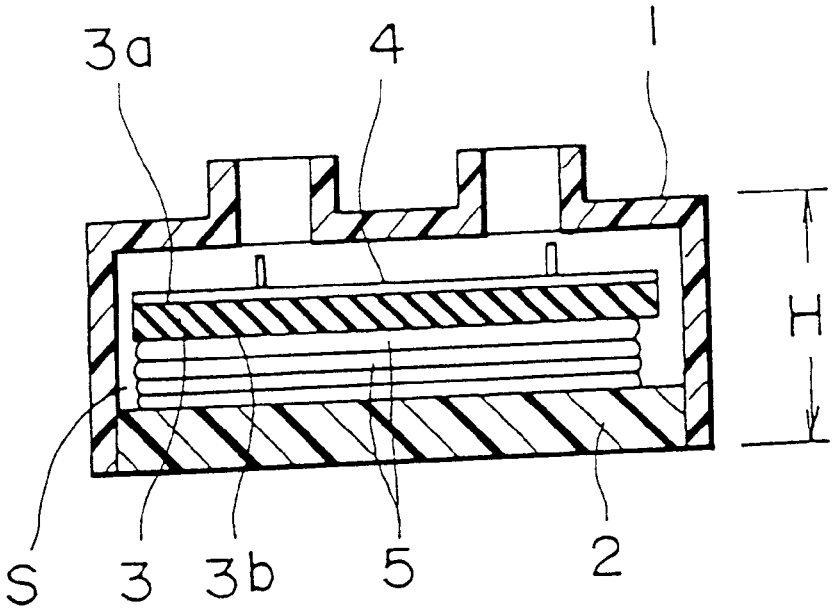
Fig. 1 PRIOR ART
FIG. 1 is a sectional view of a prior art electrical connection box (already referred to)
Figure 3:
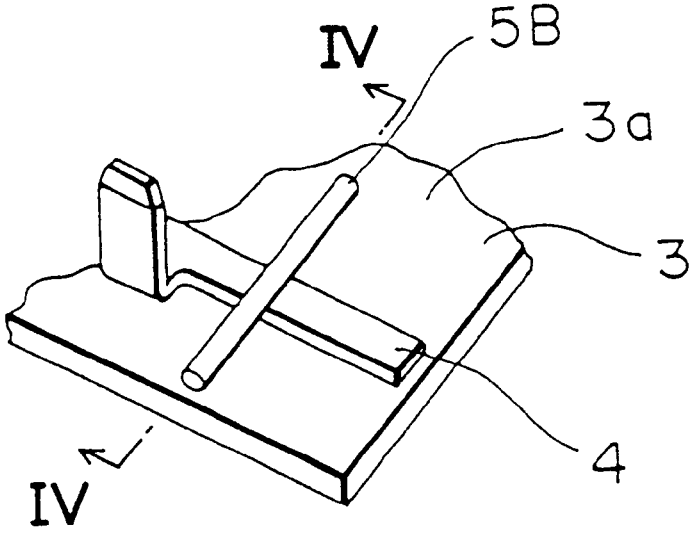
FIG. 3 is a perspective view showing a single-conductor wire placed on a flat bus bar in the electrical connection box of FIG. 2.
Figure 4:
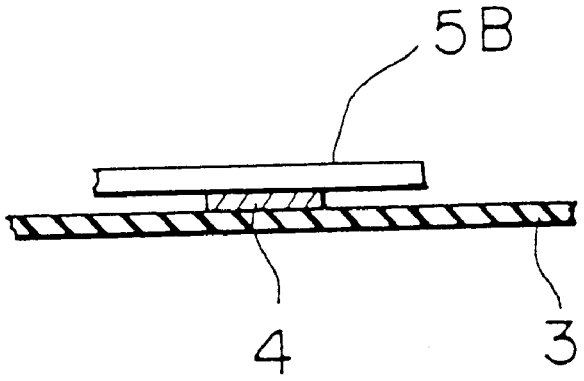
FIG. 4 is a sectional view taken along the line IV—IV in FIG. 3.
Figure 5:
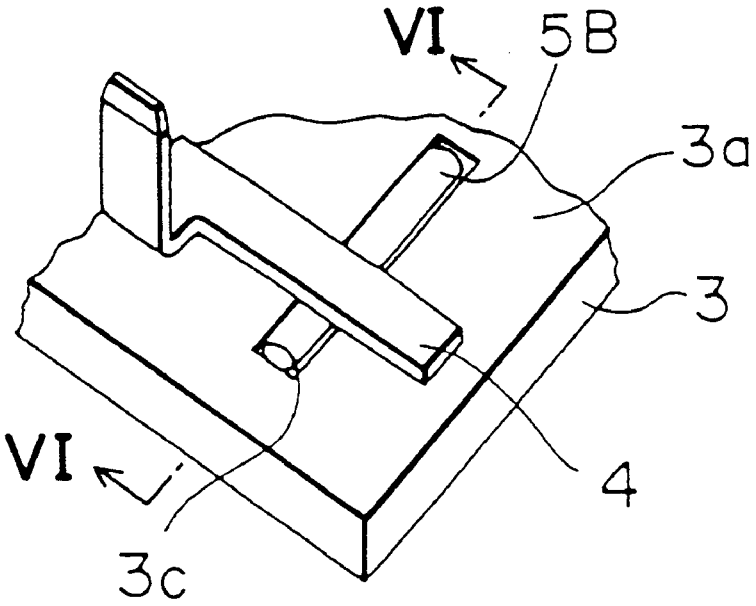
FIG. 5 is a perspective view showing a single-conductor wire placed beneath a flat bus bar in the electrical connection box of FIG. 2.
Figure 6:
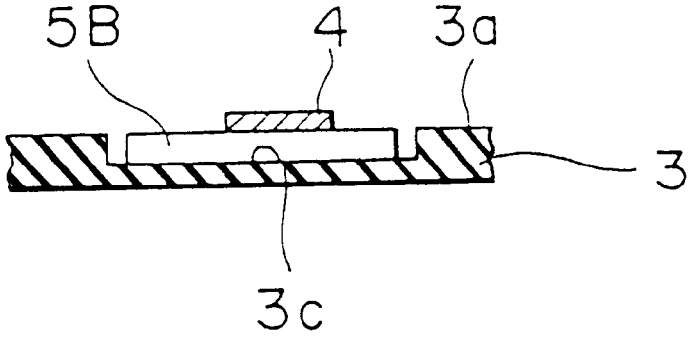
FIG. 6 is a sectional view taken along the line VI—VI in FIG. 5.
Figure 7:
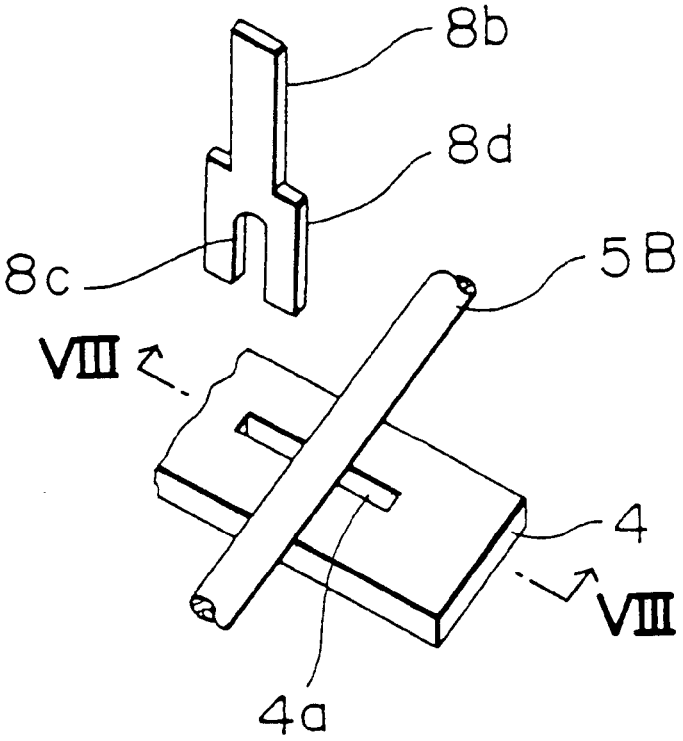
FIG. 7 is a perspective view explanatory of a method of connecting the single-conductor wire to the flat bus bar by using a pressing contact terminal in the electrical connection box of FIG. 2.
Figure 8:
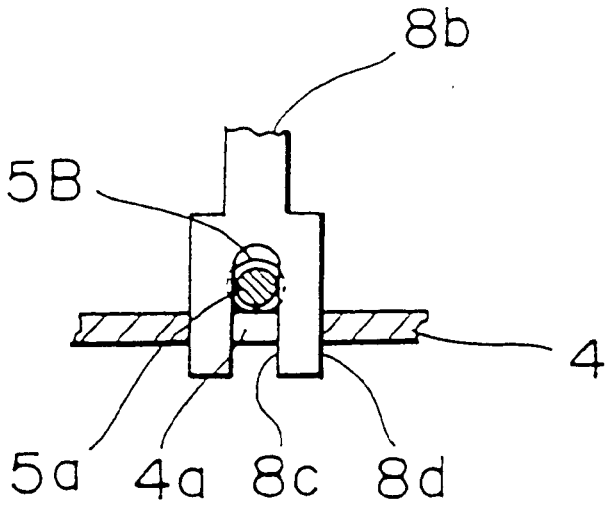
FIG. 8 is a sectional view taken along the line VIII—VIII in FIG. 7.

As shown in FIGS. 3 and 4, the circuit formed by the single-conductor wires 5B is placed on the flat bus bars 4. Alternatively, as shown in FIGS. 5 and 6, the circuit formed by the single-conductor wires 5B may also be inserted into a groove 3*c* formed on the upper face 3*a* of the insulating plate 3 so as to be disposed beneath the flat bus bars 4. Meanwhile, in case the circuit formed by the single-conductor wires 5B is placed on the flat bus bars 4, slots 4*a* may be formed on the flat bus bars 4 as shown in FIG. 7. Thus, as shown in FIG. 8, the pressing contact blade of each of the pressing contact terminals 8*b* is thrust into the insulating coating of each of the single-conductor wires 5B so as to not only bring opposed inner sides 8*c* of the pressing contact blade of each of the pressing contact terminals 8*b* into contact with a conductor 5*a* of each of the single-conductor wires 5B but bring opposite outer sides 8*d* of the pressing contact blade of each of the pressing contact terminals 8*b* into contact with opposite end faces of each of the slots 4*a* of the flat bus bars 4. As a result, since the circuit formed by the flat bus bars 4 and the circuit formed by the single-conductor wires 5B can be directly connected to each other, design changes of the internal circuit of the electrical connection box K can be performed easily.

By the above described arrangement of the electrical connection box K in which the insulating plate 3 is provided in the upper casing 6 and the lower casing 7 and the single-conductor wires 5A and 5B have a ratio of about 7 to 3, the single-conductor wires 5A are disposed in the space S2 between the insulating plate 3 and the lower casing 7, while the single-conductor wires 5B are disposed in the space S1 between the insulating plate 3 and the upper casing 6. As a result, the circuit formed by the single-conductor wires 5A and the circuit formed by the single-conductor wires 5B can be disposed in the spaces S2 and S1 of the electrical connection box K, respectively in good proportion.

Meanwhile, by distributing the single-conductor wires 5A and 5B to the spaces S2 and S1, respectively, wiring in the spaces S2 and S1 is simplified, thereby resulting in rise of productivity of the electrical connection box K. Furthermore, since dead space in the space S1 between the insulating plate 3 and the upper casing 6 is effectively used for receiving the circuit formed by the single-conductor wires 5B, a height H1 of the casing of the electrical connection box K can be reduced in comparison with those of known electrical connection boxes and thus, the casing of the electrical connection box K can be made compact in size.

As is clear from the foregoing description of the electrical connection box of the present invention, a portion of the circuit formed by the wires concentrated extraordinarily in one space between the insulating plate and the casing is shifted to the other space between the insulating plate and the casing adjacent to the circuit formed by the bus bars. Therefore, the circuit formed by the wires can be distributed, in good proportion, to the two spaces confronting the opposite faces of the insulating plate, respectively, so that wiring of the electrical connection box is facilitated and thus, productivity of the electrical connection box is raised. Furthermore, since dead space in the space between the insulating plate and the upper casing is effectively used for receiving the portion of the circuit formed by the wires, height of the casing of the electrical connection box can be reduced as compared with those of prior art electrical connection boxes and thus, the casing of the electrical connection box can be made compact in size.

Meanwhile, since the portion of the circuit formed by the wires is shifted to the space between the insulating plate and the upper casing and can be directly connected, by using the pressing contact terminals, to the circuit formed by bus bars, design changes of the internal circuit of the electrical connection box can be performed easily.

The wires forming the portion of the circuit shifted to the space between the insulating plate and the upper casing each have the insulating coating and thus, can be placed on or beneath the bus bars mixedly arbitrarily. Meanwhile, if the wires are disposed beneath the bus bars by inserting the bus bars into the wiring grooves formed on the insulating plate, the wires can be laid efficiently through effective utilization of space. Furthermore, at one side of the insulating plate where the bus bars and the wires are provided mixedly, the circuit formed by the bus bars and the circuit formed by the wires can be directly connected to each other by bringing the pressing contact terminals into contact with the bus bars.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An electrical connection box comprising:

an upper casing;

a lower casing that forms a box casing of the electrical connection box having a substantially open volume space therein, together with the upper casing;

an insulating plate that is provided within the substantially open volume space of the box casing;

wherein a first space is defined within the substantially open volume space of the box casing between the insulating plate and one of the upper and lower casings, while a second space is defined within the substantially open volume space of the box casing between the insulating plate and the other of the upper and lower casings;

a first circuit that is formed by bus bars and is disposed in the first space without extending into the second space; and a second circuit that is formed by wires and pressing contact terminals brought into pressing contact with the wires within the second space;

wherein the wires of a portion of the second circuit are shifted to the first space and are wholly disposed within the first space, while the remaining wires of the remaining portion of the second circuit are wholly disposed in the second space, the wires of the portion of the second circuit wholly disposed within the first space being brought into contact with the bus bars within the first space; and wherein the wires of the portion of the second circuit are inserted into wiring grooves formed on the insulating plate so as to be disposed beneath the bus bars.

2. An electrical connection box comprising:

an upper casing;

a lower casing that forms a box casing of the electrical connection box having a substantially open volume space therein, together with the upper casing;

an insulating plate that is provided within the substantially open volume space of the box casing;

wherein a first space is defined within the substantially open volume space of the box casing between the insulating plate and one of the upper and lower casings, while a second space is defined within the substantially open volume space of the box casing between the insulating plate and the other of the upper and lower casings;

a first circuit that is formed by bus bars and is disposed in the first space without extending into the second space; and a second circuit that is formed by wires and pressing contact terminals brought into pressing contact with the wires within the second space;

wherein the wires of a portion of the second circuit are shifted to the first space and are wholly disposed within the first space, while the remaining wires of the remaining portion of the second circuit are wholly disposed in the second space, the wires of the portion of the second circuit wholly disposed within the first space being brought into contact with the bus bars within the first space;

wherein each of the wires is a wire having a single conductor and each of the bus bars is a flat bus bar; and wherein the wires of the portion of the second circuit are inserted into wiring grooves formed on the insulating plate so as to be disposed beneath the bus bars.

3. An electrical connection box comprising:

an upper casing;

a lower casing that forms a box casing of the electrical connection box having a substantially open volume space therein, together with the upper casing;

an insulating plate that is provided within the substantially open volume space of the box casing;

wherein a first space is defined within the substantially open volume space of the box casing between the insulating plate and one of the upper and lower casings, while a second space is defined within the substantially open volume space of the box casing between the insulating plate and the other of the upper and lower casings;

a first circuit that is formed by bus bars and is disposed in the first space without extending into the second space; and a second circuit that is formed by wires and pressing contact terminals brought into pressing contact with the wires within the second space;

wherein the wires of a portion of the second circuit are shifted to the first space and are wholly disposed within the first space, while the remaining wires of the remaining portion of the second circuit are wholly disposed in the second space, the wires of the portion of the second circuit wholly disposed within the first space being brought into contact with the bus bars within the first space;

wherein the wires of the portion of the second circuit are disposed on the bus bars.

4. An electrical connection box comprising:

an upper casing;

a lower casing that forms a box casing of the electrical connection box having a substantially open volume space therein, together with the upper casing;

an insulating plate that is provided within the substantially open volume space of the box casing;

wherein a first space is defined within the substantially open volume space of the box casing between the insulating plate and one of the upper and lower casings, while a second space is defined within the substantially open volume space of the box casing between the insulating plate and the other of the upper and lower casings;

a first circuit that is formed by bus bars and is disposed in the first space without extending into the second space; and a second circuit that is formed by wires and pressing contact terminals brought into pressing contact with the wires within the second space;

wherein the wires of a portion of the second circuit are shifted to the first space and are wholly disposed within the first space, while the remaining wires of the remaining portion of the second circuit are wholly disposed in the second space, the wires of the portion of the second circuit wholly disposed within the first space being brought into contact with the bus bars within the first space;

wherein each of the wires is a wire having a single conductor and each of the bus bars is a flat bus bar; and wherein the wires of the portion of the second circuit are disposed on the bus bars.

5. An electrical connection box as claimed in claim 4, wherein a portion of each of the pressing contact terminals brought into pressing contact with the wires of the portion of the second circuit is brought into contact with each of the bus bars so as to be electrically connected to each of the bus bars.

6. An electrical connection box comprising:

an upper casing;

a lower casing that forms a box casing of the electrical connection box having a substantially open volume space therein, together with the upper casing;

an insulating plate that is provided within the substantially open volume space of the box casing;

wherein a first space is defined within the substantially open volume space of the box casing between the insulating plate and one of the upper and lower casings, while a second space is defined within the substantially open volume space of the box casing between the insulating plate and the other of the upper and lower casings;

a first circuit that is formed by bus bars and is disposed in the first space without extending into the second space; and a second circuit that is formed by wires and pressing contact terminals brought into pressing contact with the wires within the second space;

wherein the wires of a portion of the second circuit are shifted to the first space and are wholly disposed within the first space, while the remaining wires of the remaining portion of the second circuit are wholly disposed in the second space, the wires of the portion of the second circuit wholly disposed within the first space being brought into contact with the bus bars within the first space;

wherein the wires of the portion of the second circuit are disposed beneath the bus bars; and wherein the wires of the portion of the second circuit are inserted into wiring grooves formed on the insulating plate so as to be disposed beneath the bus bars.

7. An electrical connection box comprising:

an upper casing;

a lower casing that forms a box casing of the electrical connection box having a substantially open volume space therein, together with the upper casing;

an insulating plate that is provided within the substantially open volume space of the box casing;

wherein a first space is defined within the substantially open volume space of the box casing between the insulating plate and one of the upper and lower casings while a second space is defined within the substantially open volume space of the box casing between the insulating plate and the other of the upper and lower casings;

a first circuit that is formed by bus bars and is disposed in the first space without extending into the second space; and a second circuit that is formed by wires and pressing contact terminals brought into pressing contact with the wires within the second space;

wherein the wires of a portion of the second circuit are shifted to the first space and are wholly disposed within the first space, while the remaining wires of the remaining portion of the second circuit are wholly disposed in the second space, the wires of the portion of the second circuit wholly disposed within the first space being brought into contact with the bus bars within the first space;

wherein each of the wires is a wire having a single conductor and each of the bus bars is a flat bus bar; and wherein the wires of the portion of the second circuit are disposed beneath the bus bars wherein the wires of the portion of the second circuit are inserted into wiring grooves formed on the insulating plate so as to be disposed beneath the bus bars.

* * * * *